US006470722B1

(12) United States Patent
Sudau et al.

(10) Patent No.: US 6,470,722 B1
(45) Date of Patent: Oct. 29, 2002

(54) LOOPER

(75) Inventors: Peter Sudau, Hilchenbach (DE); Matthias Kipping, Herdorf (DE); Matthias Tuschhoff, Siegen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/697,677

(22) Filed: Oct. 26, 2000

(30) Foreign Application Priority Data

Nov. 5, 1999 (DE) ..... 199 53 524

(51) Int. Cl.[7] ..... B21B 37/48
(52) U.S. Cl. ..... 72/12.3; 72/8.6; 72/11.4
(58) Field of Search ..... 72/8.6, 8.7, 10.4, 72/11.4, 12.3, 205

(56) References Cited

U.S. PATENT DOCUMENTS 4,033,492 A * 7/1977 Imai ..... 72/8.6
4,116,029 A * 9/1978 Fabian et al. ..... 72/12.3
5,701,774 A * 12/1997 Imanari et al. ..... 72/8.6
5,722,279 A * 3/1998 Ogawa et al. ..... 72/8.6

FOREIGN PATENT DOCUMENTS

DE 197 15 523 A1 10/1998
JP 58-209413 * 12/1983 ..... 72/8.6

OTHER PUBLICATIONS

"Development of New High Performance Loopers for Hot Strip Mills", Iron and Steel Engineer, Jun. 1997, pp. 64–70.

* cited by examiner

*Primary Examiner*—Ed Tolan
(74) *Attorney, Agent, or Firm*—Friedrich Kueffner

(57) ABSTRACT

A looper for measuring a wedge proportion of a longitudinal pull present within a strip in a longitudinal direction of the strip, wherein the wedge proportion is present across a width of the strip, has a looper shaft and pivot arms each having a first end and a second end, wherein the first ends are connected to the looper shaft. A continuous looper roll extends across the width of the strip and is supported on the second ends of the pivot arms, wherein the looper roll is adjusted relative to the strip by rotation of the looper shaft. Each pivot arm has a looper shaft arm, a looper roll arm, and a joint connecting the looper shaft arm and the looper roll arm to one another. A dynamometer is connected to each pivot arm, wherein the joints of the pivot arms deflect a return force, exerted by the strip onto the looper roll and corresponding to the longitudinal pull, onto the dynamometers, respectively.

9 Claims, 1 Drawing Sheet

LOOPER

BACKGROUND OF THE INVENTION

1. Field of the Invention

The invention relates to a looper for measuring the wedge proportion of a longitudinal pull present within a strip in the longitudinal direction of the strip, wherein the wedge proportion extends across the strip width.

2. Description of the Related Art

A looper is known from the publication "Development of new high performance loopers for hot strip mills", Iron and Steel Engineer, June 1997, pp. 64 to 70, which comprises two dynamometers for measuring a force exerted onto the looper which corresponds to the longitudinal pull. Nothing is disclosed in this article in regard to the arrangement of the dynamometers and the general configuration of the looper.

From German patent document 197 15 523 A1 a measuring device for determining flatness is known which has a plurality of measuring rolls. The measuring rolls are individually supported on pivot arms which are connected to a looper shaft. By rotating the looper shaft the measuring rolls can be adjusted relative to the strip. The pivot arms are divided by joints into a shaft portion and a roll portion wherein the joints deflect restoring forces, exerted by the strip onto the measuring rolls and corresponding to the longitudinal pull, onto the dynamometers arranged on the respective pivot arm.

SUMMARY OF THE INVENTION

It is an object of the present invention to provide a looper having a simple configuration with which the wedge proportion, extending across the strip width, of the longitudinal pull can be measured.

In accordance with the present invention, this is achieved in that:

- the looper has a continuous looper roll extending across the strip width and being supported on both sides on a pivot arm, respectively;
- the pivot arms are connected with a looper shaft;
- when rotating the looper shaft the looper roll can be adjusted relative to the strip;
- the pivot arms are divided by a joint into a looper shaft arm and a looper roll arm;
- each joint deflects a restoring force, exerted by the strip onto the looper roll and corresponding to the longitudinal pull, onto the dynamometer arranged on the pivot arm, respectively.

When the looper roll arm is formed as a plate or as a lever frame, the looper is of an even more simplified construction.

When the looper shaft arm and the looper roll arm are connected to one another in the proximity of the dynamometer via a securing element, it is reliably prevented that the looper roll arm can lift of the dynamometer.

When the joint, the looper roll, and the dynamometer define a triangle with three sides and the securing element is arranged outside of this triangle, the securing element is exposed to comparatively low forces.

When the triangle is formed as a substantially isosceles triangle, a low mechanical loading of the looper roll arm results.

The loading of the looper roll arm can be further minimized when the triangle is formed as a substantially rectangular (right) triangle.

When one of the sides of the triangle is positioned opposite the joint and this side is longer than the two other sides of the triangle, the forces exerted onto the looper roll arm are particularly minimal.

When the looper shaft arm is at least as long as the looper roll arm, the looper is provided with a large adjusting range.

The mechanical loading is minimized when the dynamometer has a force axis and the looper roll arm performs a movement in the area of the dynamometer which is essentially parallel to the force axis.

DESCRIPTION OF THE PREFERRED EMBODIMENTS

Figure 1:
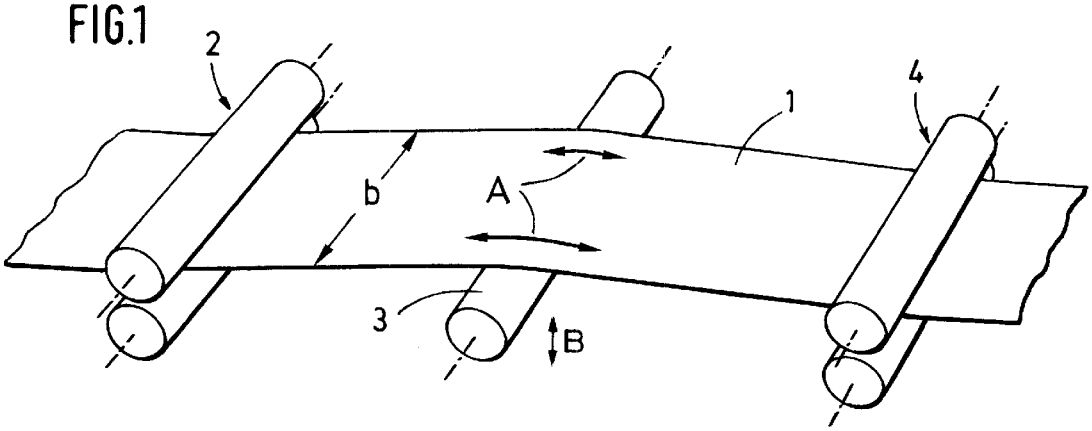
FIG. 1 is a schematic perspective view of a pull measuring arrangement.

According to FIG. 1, the metal strip 1 is guided from an outlet device 2 via a looper roll 3 to an inlet device 4. The outlet device 2 and the inlet device 4 can form together, for example, a roll stand or driver. The metal strip 1 is preferably a hot or cold rolled steel strip. It has a strip width b. The looper roll 3 according to FIG. 1 is formed as a continuous looper roll. It extends across the entire strip width b.

In the metal strip 1 a longitudinal pull is present in the longitudinal direction of the strip which is indicated in FIG. 1 by arrows A. The longitudinal pull has a wedge proportion across the strip width b which is illustrated in FIG. 1 by the different size of the arrows A. The looper roll 3 can be adjusted relative to the metal strip 1. This is indicated in FIG. 1 by the arrow B.

Figure 2:
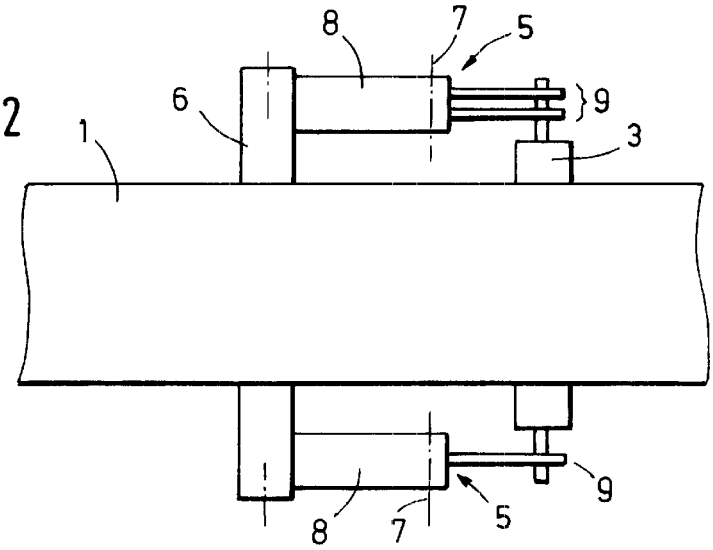
FIG. 2 shows schematically a strip with a looper from above.

According to FIG. 2, the looper roll 3 is supported on both sides on a pivot arm 5. The pivot arms 5 are connected to a looper shaft 6. Accordingly, by rotation of the looper shaft 6, the looper roll 3 can be advanced or adjusted relative to the metal strip 1.

The pivot arms 5 are divided by a joint 7 into a looper shaft arm 8 and a looper roll arm 9. According to FIG. 2, the looper roll arms 9 are plates or lever frames. The term plate refers to a massive support element while the term lever frame refers to a support element that has two plates which are separated from one another by an intermediate space. It should additionally be mentioned that in practice both looper roll arms 9 are generally of the same construction. The different embodiment of the looper roll arms 9 in FIG. 2 is provided only for illustration purposes.

Figure 3:
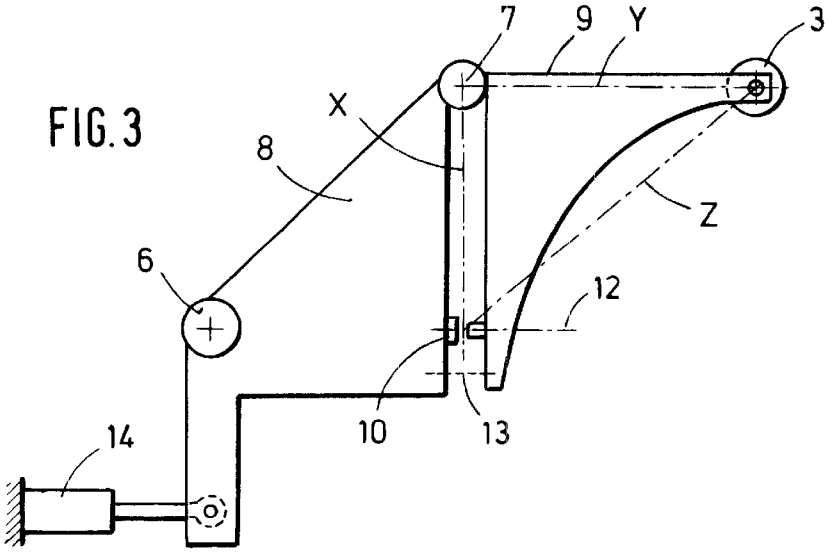
FIG. 3 shows the looper of FIG. 2 from the side.

According to FIG. 3, each one of the pivot arms 5 has a dynamometer 10 arranged on the looper shaft arm 8, wherein the dynamometer 10 rests against the looper roll arm 9. The dynamometer 10 is eccentrically arranged relative to the joint 7. Accordingly, the joint 7 deflects the restoring force, exerted by the metal strip 1 onto the looper roll 3, onto the dynamometer 10 arranged on the looper shaft arm 8, respectively.

The restoring force corresponds to the longitudinal pull. Based on the measured restoring forces, the longitudinal pull can thus be determined. Accordingly, the individual longitudinal pull is measured for each of the two dynamometers 10 of the two pivot arms 5 based on the restoring force exerted thereon. The sum of the thus determined longitudinal pull provides the total longitudinal pull present within the metal strip 1. The difference of the two thus determined longitudinal pulls provides the wedge proportion which the longitudinal pull has across the strip width b.

Based on the total longitudinal pull as well as based on the wedge proportion the outlet device 2 and/or the inlet device 4 can be readjusted. For example, it is possible to control or readjust, based on the total longitudinal pull, the rotational speed and, based on the wedge proportion, at least an adjustment of at least one of the two devices 2, 4.

According to FIG. 3, the joint 7, the looper roll 3, and the dynamometer 10 define a triangle with three sides X, Y, and Z. In this context, the terms joint 7 and looper roll 3 refer to the respective rotational axes, while the term dynamometer 10 refers to the contact point of the dynamometer 10 at the looper roll arm 9. The rotational axes and the contact point define the corners of the triangle.

It is illustrated that the triangle is substantially a right or rectangular triangle, substantially embodied as an isosceles triangle. The hypotenuse Z of the triangle is positioned opposite the joint 7. This side Z is thus longer than the two other sides X, Y. In this connection, "substantially" means that the right angle of the triangle can be between 80° and 100° and the lengths of the two identical legs of the triangle can differ from one another by maximally 10%.

The dynamometer 10 has a force axis 12. The dynamometer 10 thus only measures forces which are directed parallel to the force axis 12. The looper roll arm 9 is formed such that in the area of the dynamometer 10 it performs a movement which is directed essentially parallel to the force axis 12. In this context, "substantially" means that the movement direction of the looper roll arm 9 has an angle of maximally 10° with the force axis 12.

In the vicinity of the dynamometer 10 but outside of the triangle a securing element 13 is arranged. By means of the securing element 13 the looper shaft arm 8 and the looper roll arm 9 are connected with one another. This prevents the looper roll arm 9 from lifting off the dynamometer 10.

The looper roll arm 9 is at least as long as the looper shaft arm 8. According to FIG. 3 it is even longer than the looper roll arm 9, in particular, by approximately 20% to 100%. The length of the looper shaft arm 8 is determined by the spacing of the axis of rotation of the looper shaft 6 from the axis of rotation of the joint 7. The length of the looper roll arm 9 is defined by the spacing of the axis of rotation of the looper roll 3 from the axis of rotation of the joint 7.

Based on the comparatively large length of the looper shaft arm 8, a large adjusting range of the looper results when rotating the looper shaft 6. The rotation of the looper shaft 6 is carried out in this connection by means of an adjusting drive 14. The adjusting drive 14 according to FIG. 3 can be embodied as an eccentrically engaging hydraulic cylinder unit.

With the looper according to the invention a reliable measurement of the total longitudinal pull as well as of the wedge proportion extending across the strip width b of the longitudinal pull present within the metal strip 1 is possible. The configuration of the looper is in this connection simple, robust, and not prone to failure. Especially, it is not required to segment the looper roll 3 and to correlate each individual segment with a dynamometer.

While specific embodiments of the invention have been shown and described in detail to illustrate the inventive principles, it will be understood that the invention may be embodied otherwise without departing from such principles.

What is claimed is:

1. A looper for measuring a wedge proportion of a longitudinal pull present within a strip in a longitudinal direction of the strip, wherein the wedge proportion is present across a width of the strip, the looper comprising:

a looper shaft;

pivot arms each having a first end and a second end, wherein the first ends are connected to the looper shaft;

a continuous looper roll extending across the entire width of the strip and supported on the second ends of the pivot arms, wherein the looper roll is adjusted relative to the strip by rotation of the looper shaft;

each one of the pivot arms being comprised of a looper shaft arm, a looper roll arm, and a joint connecting the looper shaft arm and the looper roll arm to one another; and a dynamometer connected to each one of the pivot arms, wherein the joints of the pivot arms deflect a return force, exerted by the strip onto the looper roll and corresponding to the longitudinal pull, onto the dynamometers, respectively.

2. The looper according to claim 1, wherein the looper roll arm is a plate or a lever frame.

3. The looper according to claim 1, wherein the looper shaft arm and the looper roll arm are connected to one another by a securing element in proximity of the dynamometer, wherein the securing element is configured to prevent the looper roll arm from lifting off the dynamometer.

4. The looper according to claim 3, wherein an axis of the joint, an axis of the looper roll, and a contact location of the dynamometer define corners of a triangle, and wherein the securing element is located outside of the triangle.

5. The looper according to claim 4, wherein the triangle is an isosceles triangle.

6. The looper according to claim 4, wherein the triangle is a rectangular triangle.

7. The looper according to claim 4, wherein a first side of the triangle is positioned opposite the joint and wherein the first side is longer than the other two sides of the triangle.

8. The looper according to claim 1, wherein the looper shaft arm is at least as long as the looper roll arm.

9. The looper according to claim 1, wherein the dynamometer has a force axis and wherein the looper roll arm is configured to carry out a movement in the area of the dynamometer which is directed substantially parallel to the force axis.

* * * * *